US008152471B2

(12) United States Patent
Pichel

(10) Patent No.: US 8,152,471 B2
(45) Date of Patent: Apr. 10, 2012

(54) APPARATUS AND METHOD FOR RETAINING BLADED ROTOR DISKS OF A JET ENGINE

(75) Inventor: Sacha Pichel, Berlin (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 931 days.

(21) Appl. No.: 12/216,458

(22) Filed: Jul. 3, 2008

(65) Prior Publication Data

US 2009/0016886 A1 Jan. 15, 2009

(30) Foreign Application Priority Data

Jul. 6, 2007 (DE) ..... 10 2007 031 712

(51) Int. Cl.
*F02C 7/00* (2006.01)
*F01D 5/02* (2006.01)

(52) U.S. Cl. ..... 416/198 A; 416/204 R

(58) Field of Classification Search ..... 416/198 A, 416/204 R

See application file for complete search history.

(56) References Cited

U.S. PATENT DOCUMENTS

| | | | |
|---|---|---|---|
| 2,579,745 | A | 12/1951 | Lombard et al. |
| 5,537,814 | A | 7/1996 | Nastuk et al. |
| 5,628,621 | A | 5/1997 | Toborg |
| 6,267,553 | B1 | 7/2001 | Burge |
| 6,375,421 | B1 | 4/2002 | Lammas et al. |
| 2005/0025625 | A1 | 2/2005 | Escure et al. |

FOREIGN PATENT DOCUMENTS

| | | |
|---|---|---|
| DE | 1087746 | 8/1960 |
| DE | 102005052819 | 5/2007 |
| EP | 1122443 | 8/2001 |
| GB | 599809 | 3/1948 |
| GB | 749578 | 5/1956 |
| GB | 858763 | 1/1961 |

OTHER PUBLICATIONS

European Search Report dated Apr. 12, 2011 from counterpart application.

German Search Report dated Dec. 9, 2008 from counterpart German patent application No. 102007031712.5.

*Primary Examiner* — Alexander Ghyka

(74) *Attorney, Agent, or Firm* — Timothy J. Kilma; Shuttleworth & Ingersoll, PLC

(57) ABSTRACT

An apparatus (3) retains bladed rotor disks (4, 6, 9) of a jet engine which engine includes an axial-flow compressor with several bladed rotor disks (4, 6, 9), at least one turbine section, at least one shaft and at least one tie-rod (12, 47), with at least two bladed rotor disks at the compressor inlet side (2) being designed as blisks (6), each being a single component integrally combining a rotor disk and circumferentially distributed rotor blades (5). So that apparatus for the retention of blisks can easily be mounted and demounted, the blisks (6) are releasably retained via the tie-rod (12, 47) and the other rotor disks (4, 9) are firmly attached to each other separately and independently of the tie-rod (12, 47).

17 Claims, 4 Drawing Sheets

APPARATUS AND METHOD FOR RETAINING BLADED ROTOR DISKS OF A JET ENGINE

Figure 1:
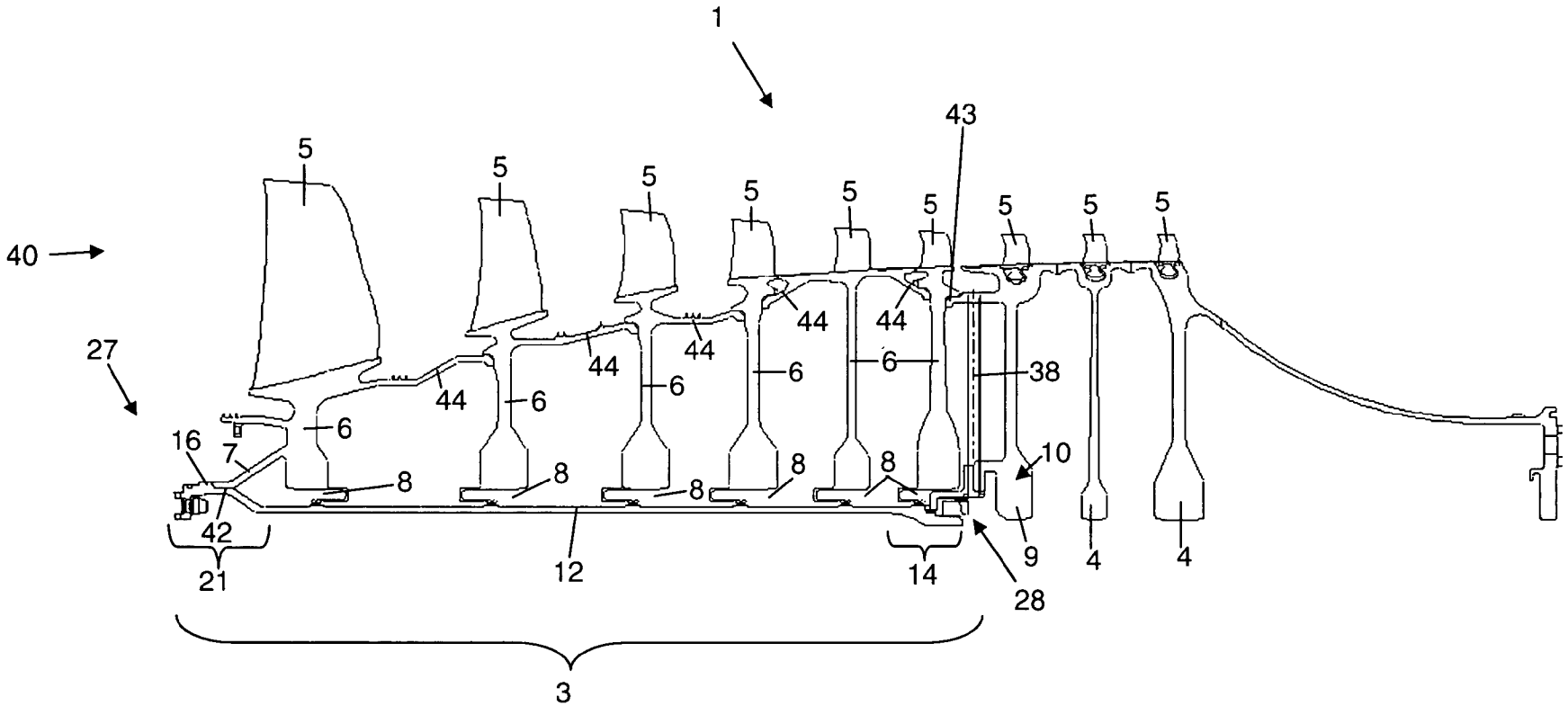

This application claims priority to German Patent Application DE102007031712.5 filed Jul. 6, 2007, the entirety of which is incorporated by reference herein.

This invention relates to an apparatus for retaining bladed rotor disks of a jet engine and to an application of the apparatus on a jet engine. Furthermore, the present invention relates to a method for retaining bladed rotor disks in a jet engine by way of the apparatus.

In turbine engines, the turbine and the compressor are usually arranged on a shaft. The compressor, in particular the axial-flow type, includes several rotor disks, each carrying a blade row and being welded or threadedly connected to each other.

On some compressors, only a part of the compressor on the inlet side includes blisks (bladed disks), with each single blisk being integrally formed of a disk and the appertaining blades. This type of design permits considerable weight savings to be made, in particular in the forward part of the drum. For better replaceability and repair, these generally fairly expensive individual components are preferably threadedly connected instead of being welded. This is accomplishable by incorporation of individual flanges which, however, increase weight and impair the rotordynamic behavior.

Furthermore, arrangements are known in which all rotor disks of the compressor or the entire rotor are retained by way of tie-rods.

Retention of a larger number of disks is, however, problematic in that an adequately high pre-load must be maintained throughout the entire operating range, requiring the thermal characteristics of both rotor and tie-rod to be properly matched. In addition, the tie-rod must have adequate stiffness.

The use of tie-rods is further problematic if the blisks must be removed in the case of damage. Here, the entire rotor, or at least the entire compressor, would invariably have to be disassembled to enable the blisks to be replaced. In addition, installation and removal of vortex reducers, for example in tubular design, if applicable, will be difficult to accomplish.

U.S. Pat. No. 6,267,553 B1 discloses a gas turbine with a high-pressure compressor, featuring several, tubular tie-rods. The tie-rods are passed through apertures in the rotor disks disposed radially around the disk center. Retention is accomplished via bolts threadedly engaging the inner threads of the tie-rods.

U.S. Pat. No. 5,537,814 describes a tie-rod for a gas-turbine propulsion unit which retains the rotor disks of both compressor and turbine. Here, the tie-rod is a hollow shaft threadedly engaging the blisk of the first stage. Downstream of a radial compressor rotor wheel, a nut threadedly engages a thread on the tie-rod to tension the tie-rod.

Passage of a tie-rod through the disks requires the provision of additional holes in the disks or enlargement of the disk inner diameters, resulting in an increase in disk weight.

In addition, a one-piece shaft does not support the individual modularity of compressor and turbine. Air passage through a vortex reducer, if applicable, is hindered.

The length of the tie-rod as well as the different materials and expansion co-efficients of the disks make it difficult to thermally match shaft and rotor and, consequently, maintain a uniform pre-load. The variability of the pre-load in operation and the length of the tie-rod affect the stiffness of the rotor.

For minimum thermal load and, consequently, low weight of the disks, the temperature gradient along the disk should be relatively low. Since the temperature at the rotor outer diameter increases from stage to stage, a uniform temperature in the interior of the rotor will, however, result in considerable temperature gradients on individual disks.

In a broad aspect the present invention provides for an apparatus for retaining bladed rotor disks which can be easily mounted and demounted.

According to the present invention, an apparatus is provided for retaining the bladed rotor disks of a jet engine—which essentially includes an axial-flow compressor with several bladed rotor disks, at least one turbine section, at least one shaft and at least one tie-rod, with at least two bladed rotor disks at the compressor inlet side being designed as blisks, each being a single component integrally combining a rotor disk and circumferentially distributed rotor blades—by which the blisks are releasably retained via the tie-rod and the other rotor disks are firmly attached to each other separately and independently of the tie-rod.

Retaining the blisks by use of a tie-rod provides for ease of assembly and disassembly during installation and maintenance or in the case of damage. The blisks can here be easily installed or removed, with no need to release multiple bolted connections, for example. As the blisks are retained separately from the other rotor disks, the tie-rod will have a short length and, thus, good stiffness.

The tie-rod is essentially tubular, disposed within central apertures in the blisk-type rotor disks and firmly attached to a shaft driven by at least one turbine section. The central apertures, inherent in the blisks, may easily be used for installation and removal of the tie-rod, with no need to provide additional holes in the disks. The tie-rod is not passed through the rotor disks disposed downstream of the blisks, so that there is no need to increase the disk diameter of these rotor disks.

The blisks are retained by the tie rod between at least one first arrangement disposed upstream of the blisks and at least one second arrangement disposed downstream of the blisks and connected to a rotor disk disposed immediately downstream of the blisks. This enables the blisks to be retained independently of the connection between the other rotor disks.

Preferably, the first arrangement is a locating arrangement and the second arrangement a tensioning arrangement. The tensioning arrangement enables the blisks to be easily clamped relative to the locating arrangement.

The locating arrangement comprises, upstream of the blisks, a protrusion of a blisk of the first stage which adjoins a location on the tie-rod. This is a simple form of a locating arrangement.

The tensioning arrangement includes at least one tensioning element serving for the transmission of force between the tie-rod and the rotor disk.

The tensioning element is essentially annular and includes a flange-type attaching portion extending in the radially outward direction, an axial tubular center portion, and a tensioning portion extending in the radially inward direction. This provides for a circumferentially uniform transmission of forces.

The attaching portion—extending in the radially outward direction—of the tensioning element attaches to a portion of the rotor disk disposed immediately downstream of the blisks. Thus, the tension produced in the tensioning element and in the tie-rod is transmitted to the rotor disk.

The attaching portion—extending in the radially outward direction—of the tensioning element attaches to a radially inner portion of the rotor disk disposed immediately downstream of the blisks.

In an advantageous embodiment, the attaching portion of the tensioning element attaches to a radially inner portion of the rotor disk disposed immediately downstream of the blisks. Forces are transmitted in this case without major deflections.

Preferably, the tie-rod is provided at its downstream end with a step whose outer diameter is smaller than the outer diameter of an adjoining upstream portion of the tie-rod, and the tensioning portion—extending in the radially inward direction—of the tensioning element radially embraces the step, with the tensioning portion—extending in the radially inward direction—of the tensioning element being axially moveable relative to the step and, in operation, remote from an axial limitation of the step and adjoining the tensioning means. This arrangement has the advantage of low constructional investment and ease of assembly and disassembly.

More particularly, the tensioning means can be a tie-rod nut which is threadedly engageable on an external threading on the step of the tie-rod. The tie-rod nut allows for proper setting of the tension between the blisks.

Alternatively, the first arrangement includes, upstream of the blisks, a tensioning device with a tensioning means, while the second arrangement, downstream of the blisks, includes at least one bolted connection between the tie-rod and the rotor disk. This alternative provides for good accessibility to the tensioning means.

Preferably, the upstream end of the tie-rod adjoins radially from the inward side a tubular, upstream protrusion of the blisk of the first stage. The tensioning means axially adjoins the protrusion and radially the tie-rod ring next to the upstream end of the tie-rod, and the tie-rod is, at its downstream end, provided with a flange attaching to the rotor disk disposed immediately downstream of the blisks. Here, the first arrangement provides for the generation of tension relative to the rotor disk immediately downstream of the blisks and is characterized by very low constructional investment. The tensioning means is well accessible from the compressor inlet side.

The tie-rod is provided with a taper in the direction of flow, and the flange of the tie-rod attaches to a radially outward portion of the rotor disk disposed immediately downstream of the blisks. This enables the blisks to be tensioned near the blade and a good seal between the blisks to be achieved. Attachment on the radially outward portion of the rotor disk disposed immediately downstream of the blisks will produce a low bending stress in the rotor disk as the tie-rod is tensioned.

The upstream end of the tie-rod is attached to the tie-rod ring, which is provided with an external threading, by use of at least one bolted connection, and the tensioning means is a tie-rod nut which is threadedly engageable on the external threading of the tie-rod ring. The tie-rod nut enables the tension in the tie-rod ring, in the bolted connections and in the tie-rod to be well set.

Preferably, the tensioning means simultaneously retains a radially inner bearing ring of a tie-rod bearing. Thus, additional components for attaching the bearing ring are not required.

At least one vortex reducer of the tubular type can be attached to the rotor disk disposed immediately downstream of the blisks. Through the vortex reducer, compressed, heated air flows radially from the outside to the inside and is fed to the turbine for cooling. By arranging the vortex reducer outside of the blisks, local heating in the disk area of the blisks is avoided. Furthermore, attachment of the vortex reducers outside of the blisks is more easily accomplishable.

It is a further aspect of the present invention to apply the above-described apparatus for retaining the blisks in a jet engine. The apparatus, while being robust, is characterized by low constructional investment.

It is a still further aspect of the present invention to provide a method for the retention of blisks by use of the apparatus described above, in which the blisks are releasably retained by the tie-rod, while the other rotor disks are firmly attached to each other separately and independently of the tie-rod. Separate retention of the blisks allows the blisks to be easily assembled and disassembled.

More particularly, the blisks are retained by the tie-rod between an arrangement disposed upstream of the blisks and an arrangement disposed downstream of the blisks and connected to a rotor disk disposed immediately downstream of the blisks. The two arrangements enable a force to be applied to the tie-rod.

The tie-rod is tensioned by the second arrangement disposed downstream of the blisks.

Alternatively the tie-rod may be tensioned by the first arrangement disposed upstream of the blisks. This provides for a good accessibility of the arrangement.

Two examples of the apparatus for retaining the bladed rotor disks of a jet engine in accordance with the present invention are more fully described in light of FIGS. 1 to 4.

Figure 2:
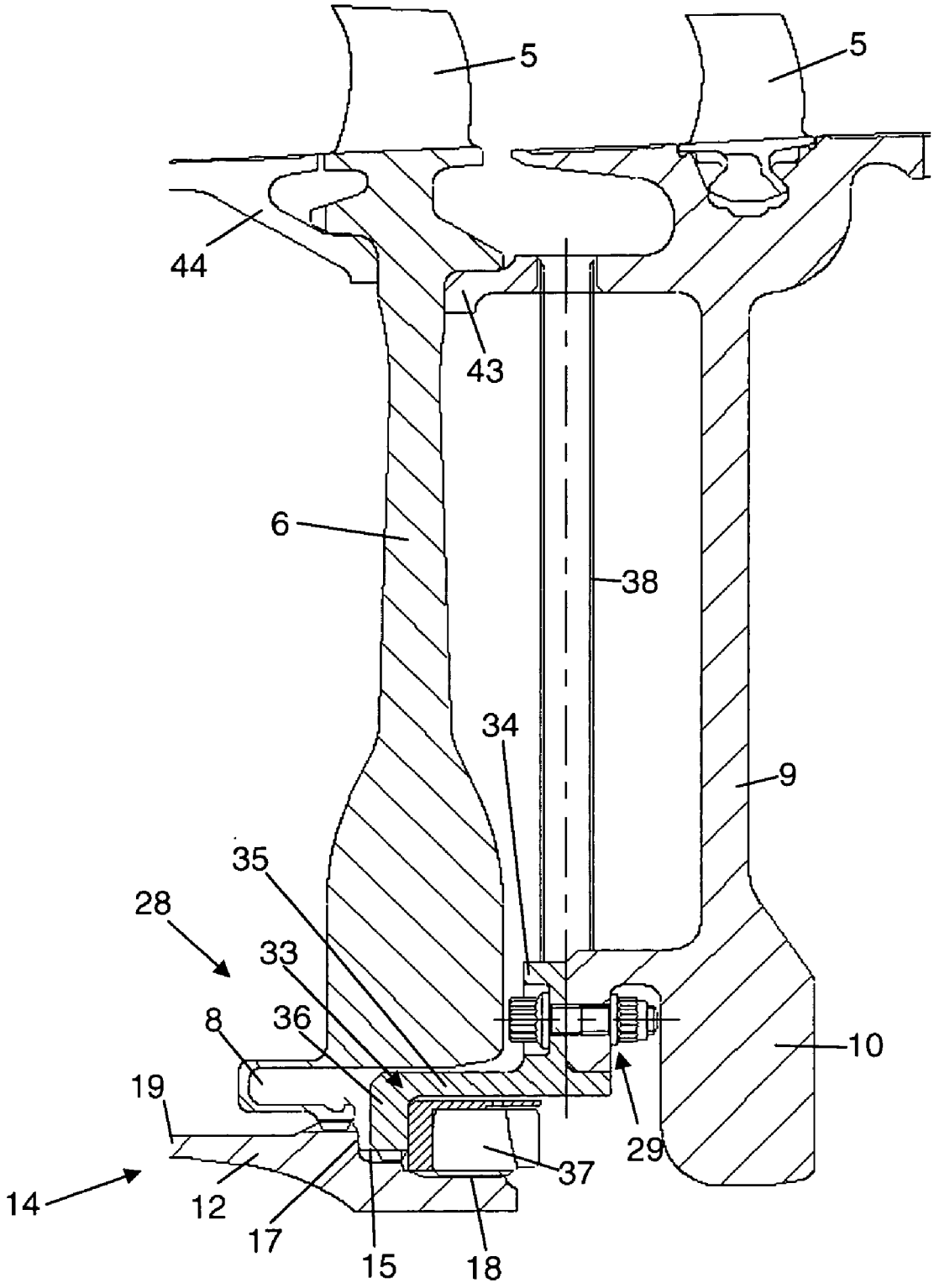
Figure 3:
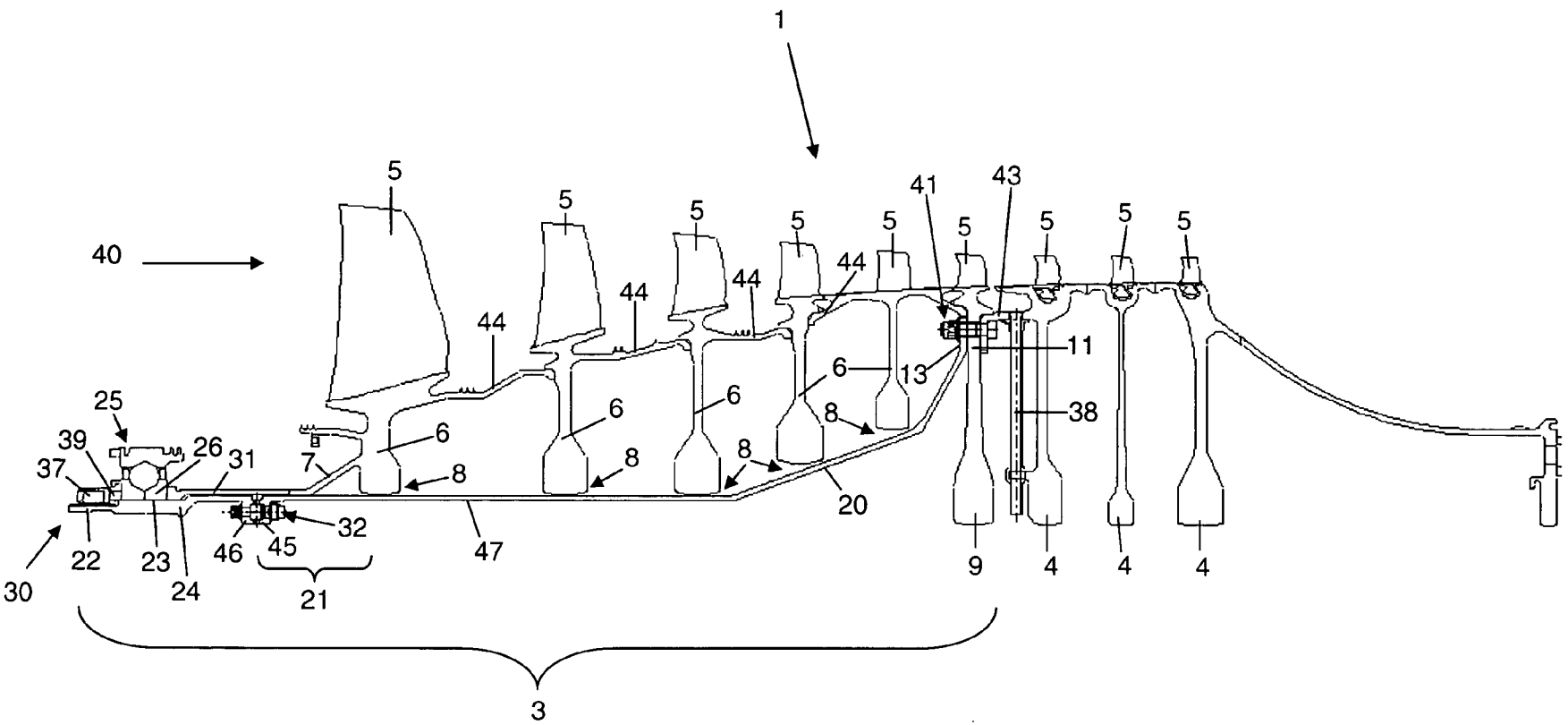
Figure 4:
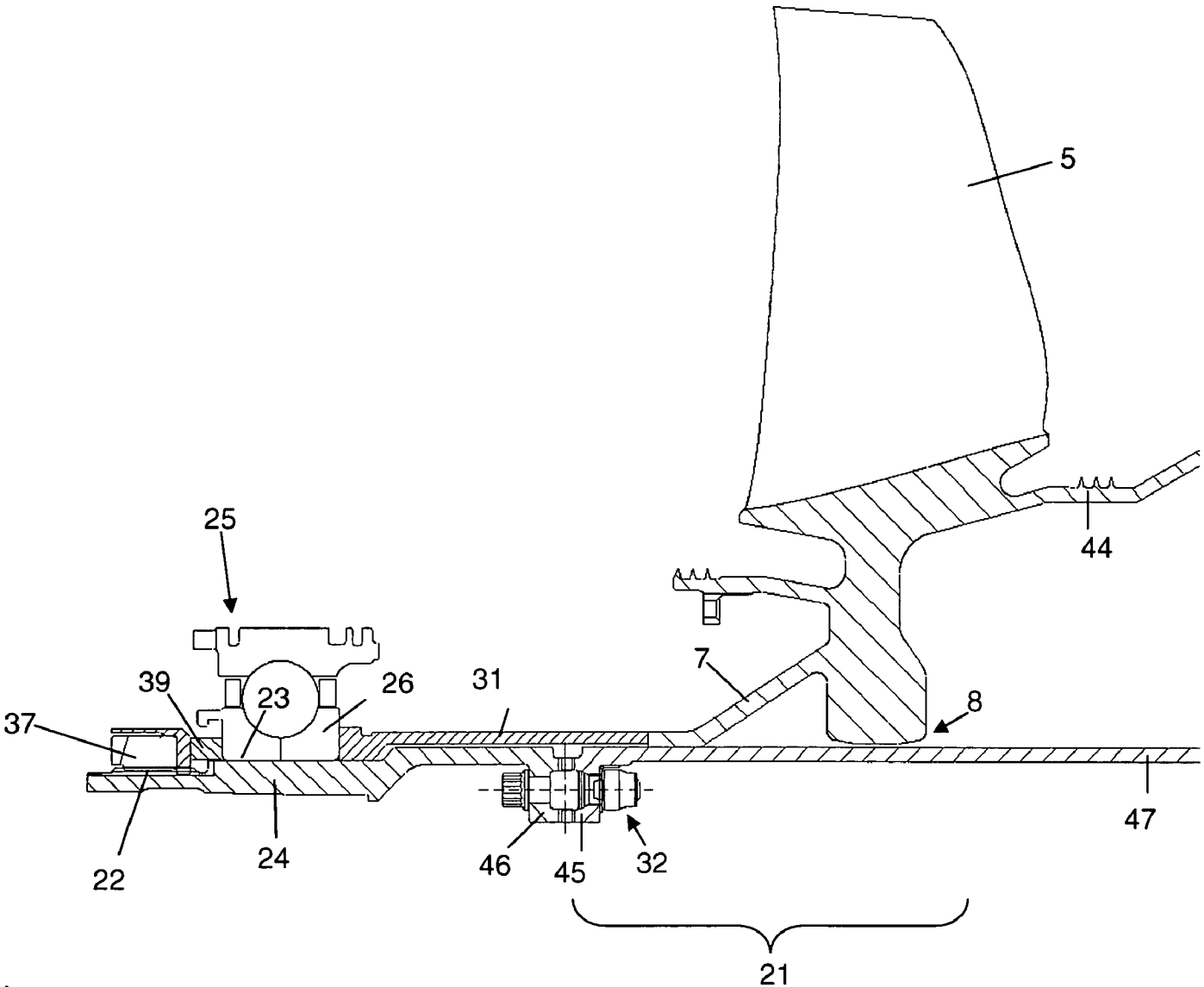

FIG. 1 shows a first embodiment with the tie-rod being tensioned from the side downstream of the blisks, FIG. 2 is a detailed view of the retaining apparatus of the first embodiment, FIG. 3 shows a second embodiment, with the tie-rod being tensioned from the side upstream of the blisks, and FIG. 4 is a detailed view of the retaining apparatus of the second embodiment.

FIG. 1 shows a rotor 1 of a nine-stage axial-flow compressor including six rotor disks in the form of blisks 6, three rotor disks 4, 9 with rotor blades 5, and at least one vortex reducer 38. Also, the rotor 1 is provided with an apparatus 3 in accordance with the present invention used for retaining the blisks 6.

On the rotor 1 of the compressor, the first six bladed rotor disks 6 in flow direction 40 are provided as blisks 6. The blisks (bladed disks) 6 are bladed rotor disks, each of which forms an integral component with its respective blading. The blisks 6 are followed, in flow direction 40, by three bladed rotor disks 4, 9 to which the rotor blades 5 are separably attached. The rotor disk 9 adjoins the blisk 6 which is last in flow direction 40. However, any other number of blisks 6 and rotor disks 4, 9 is applicable. Likewise, the number of stages is variable. Each blisk 6 is provided, near the rotor blades 5, with at least one axial protrusion 44 abutting against at least one adjacent blisk 6. The rotor disk 9 abuts, with an axial protrusion 43 disposed near the rotor blades 5, against the blisk 6 which is last in flow direction 40.

The first embodiment of the apparatus 3 according to the present invention illustrated in FIG. 1 and FIG. 2 comprises a tie-rod 12, a locating arrangement 27 and a tensioning arrangement 28 shown in FIG. 2 in enlarged representation.

The tie-rod 12 is tubular and is provided, at its upstream end 21, with a step 42 featuring a location 16, the step being offset in the radially inward direction. At the downstream end 14 of the tie-rod 12 (FIG. 2), a step 15 is provided which is offset relative to an axial portion 19 of the tie-rod 12 in the radially inward direction and confined against the flow direction 40 by an axial limitation 17. The step 15 can also feature a toothed rim. In the downstream direction, the step 15 is adjoined by an external threading 18 whose outer diameter is smaller than the outer diameter of the step 15.

The tie-rod 12 is centrally disposed within apertures 8 in the blisks 6. At its upstream end 21, the tie-rod 12 adjoins, in the locating arrangement 27, a blisk 6 of the first compressor stage. At its downstream end 14, the tie-rod 12 is connected, via the tensioning arrangement 28, to the rotor disk 9 disposed immediately downstream of the blisks 6.

The locating arrangement 27 is disposed at the upstream end 21 of the tie-rod 12 and comprises a location 16, a step 42 and a protrusion 7 of the blisk 6 of the first compressor stage.

The location 16 forms an axial confinement of the step 42 in flow direction 40. The protrusion 7 of the blisk 6 of the first compressor stage extends axially against the flow direction 40 to the location 16. It radially embraces the location 16, but is axially moveable.

The tensioning arrangement 28 shown in enlarged representation in FIG. 2 includes the step 15 of the tie-rod 12, a tensioning element 33, a tie-rod nut 37, several bolted connections 29 and adjoins the rotor disk 9 disposed immediately downstream of the blisks.

The tensioning element 33 comprises a radial attaching portion 34 in the form of a flange, a center portion 35 and a tensioning portion 36. The center portion 35 of the tensioning element 33 is tubular and, in the assembled state, extends axially and in parallel to the tie-rod 12. The flange-type attaching portion 34 extends in the radially outward direction from the downstream end of the tensioning element 33. The tensioning portion 36 extends in the radially inward direction from the upstream end of the tensioning element 33 and may feature a toothed rim.

The tensioning element 33 is, at its attaching portion 34, attached to an inner portion 10 of the rotor disk 9 by the bolted connections 29. In the assembled state of the tensioning arrangement 28, the tensioning portion 36 extends parallelly to the axial limitation 17 and, at a certain axial distance from the latter, in the radially inward direction and embraces the step 15, with the step 15 being axially moveable relative to the tensioning portion 36. If the step 15 and the tensioning portion 36 are provided with toothed rims, the toothing of the tensioning portion 36 engages the toothing of the step 15. In flow direction 40, the tie-rod nut 37, which is threaded onto the external threading 18, adjoins the tensioning portion 36.

For retaining the blisks 6, the flange-type tensioning portion 34—extending in the radially outward direction—of the tensioning element 33 is firstly attached at the inner portion 10 of the rotor disk 9 disposed immediately downstream of the blisks 6 using several, circumferentially distributed bolted connections 29. Subsequently, the blisks 6 are fitted onto the tie-rod 12. Then, the tie-rod 12 is inserted with the step 15 into the annular tensioning element 33. Finally, the tie-rod nut 37 is threaded onto the external threading 18 of the tie-rod 12 and tightened.

As the tie-rod nut 37 is tightened, a tensile force is produced in the tensioning element 33 via the tensioning portion 36 extending in the radially inward direction. Simultaneously, the tie-rod nut 37 produces a tensile force in the tie-rod 12 via the external threading 18.

The tensile force in the tensioning element 33 is transmitted from the tensioning portion 36 extending in the radially inward direction via the axial center portion 35, the attaching portion 34 extending in the radially outward direction and the bolted connections 29 to the radially inward portion 10 of the rotor disk 9. From there, the force is transmitted radially to the outside into the rotor disk 9 disposed immediately downstream of the blisks and further into the axial protrusion 43 of the rotor disk 9. The tensile force in the tie-rod 12 is transmitted along the tie-rod 12 onto the step 16. Both tensile forces effect compressive forces between the axial protrusion 43 of the rotor disk 9, the blisks 6 abutting against each other via the protrusions 44, and the location 16 of the upstream locating arrangement 27. These compressive forces axially press the blisks 6 against each other at the protrusions 44 of the blisks 6 provided near the blades 5, thereby effecting retention.

The compressive forces must be high enough to hold the blisks 6 together. However, the compressive forces shall not amount to a level at which the components of the apparatus 3 which are loaded in tension, namely the tie-rod 12, the external threading 18 on the tie-rod 12, the tensioning element 33, the bolted connections 29 or the internal threading of the tie-rod nut 37 would be overloaded in operation.

FIGS. 3 and 4 show the second embodiment of the apparatus 3 according to the present invention in which the rotor 1 of the compressor is exactly designed as in FIG. 1.

The second embodiment of the apparatus 3 comprises a tie-rod 47, several bolted connections 41 and a tensioning arrangement 30 shown in enlarged representation in FIG. 4.

The tie-rod 47, unlike the tie-rod 12 of the first embodiment, is provided with a taper 20 in flow direction 40. At its upstream end 21, the tie-rod 47 is provided with a flange 45 extending in the radially inward direction. At its downstream end, the taper features a flange 13 extending in the radially outward direction.

The tie-rod 47 is centrally disposed in apertures 8 in the blisks 6. At its upstream end 21, the tie-rod 47 adjoins—radially from the inside—an axial protrusion 7 of the blisks 6 of the first compressor stage. At its downstream end, the tie-rod 47 is connected via several, circumferentially distributed bolted connections 41 to the rotor disk 9 disposed immediately downstream of the blisks 6.

The bolted connections 41 are circumferentially distributed on a radially outward portion 11 of the rotor disk 9 disposed immediately downstream of the blisks. The flange 13 at the end of the taper 20 of the tie-rod 47 is attached to the rotor disk 9 by the bolted connections 41.

The upstream tensioning arrangement 30 is shown in enlarged representation in FIG. 4 and includes a tie-rod ring 24, several bolted connections 32, a first spacer ring 31, a second spacer ring 39, a tie-rod bearing 25 and a tie-rod nut 37.

The tie-rod ring 24 is annular and features the same outer diameter as the tie-rod 47. The tie-rod ring 24 is provided, at its end adjoining the tie-rod 47, with a flange 46 extending in the radially inward direction. Furthermore, the tie-rod ring 24 is provided with a step 23 whose outer diameter is smaller than the diameter of the upstream end 21 of the tie-rod 47. At the upstream end of the tie-rod ring 24, an external threading 22 is provided whose diameter is smaller than that of the step 23.

The first spacer ring 31 is annular and features largely the same inner diameter as the axial protrusion 7 of the blisk 6 of the first compressor stage. The second spacer ring 39 is also annular.

The tie-rod bearing 25 is a ball bearing with a radially inner bearing ring 26.

The tie-rod ring 24 axially adjoins the upstream end 21 of the tie-rod 47 and forms an axial extension of the tie-rod 47 opposite to flow direction 40. The tie-rod ring 24 is attached to the flange 45 of the tie-rod 47 by means of several bolted connections 32. In the radial direction, the tie-rod ring 24 adjoins the first spacer ring 31 from the inside.

The protrusion 7 radially embraces the tie-rod 47, with the protrusion 7 being moveable relative to the tie-rod 47.

The first spacer ring 31 embraces the tie-rod 47 in the area of the flange 45 and the tie-rod ring 24, with axial moveability being provided. At its downstream end, the first spacer ring 31 adjoins the protrusion 7 of the blisk 6 of the first compressor stage. At its upstream end, the spacer ring 31 radially embraces the step 23 of the tie-rod ring 24, with axial moveability being provided.

The inner bearing ring 26 of the tie-rod bearing 25 is moveably arranged in the axial direction on the step 23 of the tie-rod ring 24. The inner bearing ring 26 adjoins the first spacer ring 31 in downstream direction and the second spacer ring 39 in upstream direction.

The second spacer ring 39 also embraces the step 23 of the tie-rod ring 24. The second spacer ring 39 here protrudes beyond the upstream end of the step 23.

The clamping nut 37, which is threaded onto the external threading 22 of the tie-rod ring 24, adjoins the second spacer ring 39.

For retention of the blisks 6, the flange 13 at the downstream end of the tie-rod 47 is firstly attached to the rotor disk 9 disposed immediately downstream of the blisks. This is accomplished by the bolted connections 41. Subsequently, the blisks 6 are fitted onto the tie-rod 47. The tie-rod ring 24 is then attached to the tie-rod 47 by the bolted connections 32. Then, the first spacer ring 31, the inner bearing ring 26 and the second spacer ring 39 are fitted over the tie-rod ring 24. Finally, the tie-rod nut 37 is threaded onto the external threading 22 of the tie-rod ring 24 and tightened.

As the tie-rod nut 37 is tightened, tensile forces are produced in the tie-rod 47, the tie-rod ring 24 and the bolted connections 41. The tensile forces are transmitted to the rotor disk 9 by the bolted connections 41.

Simultaneously, compressive forces are produced in the second spacer ring 39, in the inner bearing ring 26, in the first spacer ring 31 and in the protrusions 44 of the blisks 6 near the rotor blades 5 by which the blisks 6 are retained.

The compressive forces must be high enough to hold the blisks 6 together. However, the compressive forces shall not amount to a level at which the tensile-loaded components of the apparatus 3, namely the tie-rod ring 24, the external threading 22 on the tie-rod ring 24 or the internal threading of the tie-rod nut 37, the tie-rod 47, the bolted connections 32 and the bolted connections 41 would be overloaded in operation.

The vortex reducer 38 is, in both the first and the second embodiment, arranged at the downstream side of the rotor disk 9 disposed immediately downstream of the blisks, so that it is situated between the rotor disk 9 and the rotor disk 4 adjoining this rotor disk 9.

For the components of the apparatus for the retention of rotor disks of a jet engine, thermally and mechanically highly loadable materials are used. The materials for components loaded in tension must have high tensile strength. The tie-rod 12, 47 and the rotor disk 9, in particular, must also have high bending stiffness. The components loaded in compression must accordingly have high compressive strength. Furthermore, all components of the apparatus must have high fatigue strength.

LIST OF REFERENCE NUMERALS

1 Rotor
3 Apparatus
4 Rotor disk
5 Rotor blade
6 Rotor disk (blisk)
7 Protrusion
8 Aperture
9 Rotor disk
10 Portion
11 Portion
12 Tie-rod
13 Flange
14 End of tie-rod (downstream)
15 Step
16 Location
17 Axial limitation
18 External threading
19 Portion
20 Taper
21 End of tie-rod (upstream)
22 External threading
23 Step
24 Tie-rod ring
Tie-rod bearing
26 Bearing ring
27 Locating arrangement
28 Tensioning arrangement
29 Bolted connection
30 Tensioning arrangement
31 Spacer ring
32 Bolted connection
33 Tensioning element
34 Attaching portion (flange)
35 Center portion
36 Tensioning portion
37 Tie-rod nut
38 Vortex reducer
39 Spacer ring
40 Flow direction
41 Bolted connection
42 Step
43 Protrusion
44 Protrusion
45 Flange
46 Flange
47 Tie-rod

What is claimed is:

1. An apparatus for retaining bladed rotor disks in a jet engine which includes an axial-flow compressor having a plurality of bladed rotor disks, with at least two bladed rotor disks at a compressor inlet side being designed as blisks where each blisk integrally combines a rotor disk and circumferentially distributed rotor blades; at least one turbine section; and at least one shaft interconnecting the compressor and turbine section; comprising:

at least one tie-rod, releasably retaining the blisks to one of the rotor disks disposed immediately downstream of the blisks while other rotor disks are firmly attached to each other and the one of the rotor disks separately and independently of the tie-rod such that the blisks can be separated from the rotor disks while the rotor disks remain attached to one another;

wherein the tie-rod is essentially tubular, coaxial with an axis of the compressor, disposed within central apertures in the blisks and firmly attached to the shaft;

wherein the tie rod includes at least one first arrangement disposed upstream of the blisks and at least one second arrangement disposed downstream of the blisks and connected to the one rotor disk disposed immediately downstream of the blisks and the blisks are retained via the tie rod between the first arrangement and the second arrangement.

2. The apparatus of claim 1, characterized in that the first arrangement is a locating arrangement and the second arrangement a tensioning arrangement.

3. The apparatus of claim 2, wherein the locating arrangement comprises, upstream of the blisks, a protrusion of a blisk of the first compressor stage which adjoins a locating portion on the tie-rod.

4. The apparatus of claim 2, wherein the tensioning arrangement comprises at least one tensioning element.

5. The apparatus of claim 4, wherein the tensioning element is essentially annular and comprises a flange-type attaching portion extending in a radially outward direction, an axial tubular center portion, and a tensioning portion extending in a radially inward direction.

6. The apparatus of claim 5, wherein the attaching portion attaches to a portion of the rotor disk disposed immediately downstream of the blisks.

7. The apparatus of claim 6, wherein the attaching portion attaches to a radially inner portion of the rotor disk disposed immediately downstream of the blisks.

8. The apparatus of claim 7, wherein the tensioning element is retained by at least one tensioning device.

9. The apparatus of claim 8, wherein the tie-rod includes, at its downstream end, a step, whose outer diameter is smaller than an outer diameter of an adjoining upstream portion of the tie-rod, and that the tensioning portion radially embraces the step, with the tensioning portion being axially moveable relative to the step and, in operation, being remote from an axial limitation of the step and adjoining the tensioning device.

10. The apparatus of claim 9, wherein the tie-rod includes an external threading adjoining the step and the tensioning device is a tie-rod nut which is threadedly engageable on the external threading.

11. The apparatus of claim 1, wherein the first arrangement comprises, upstream of the blisks, a tensioning device with a tensioning device, while the second arrangement, downstream of the blisks, comprises at least one bolted connection between the tie-rod and the rotor disk.

12. The apparatus of claim 11, wherein an upstream end of the tie-rod adjoins radially from an inward side a tubular, upstream protrusion of the blisk of the first stage, the tensioning device axially adjoins the protrusion and radially adjoins a tie-rod ring attached to the upstream end of the tie-rod, and the tie-rod includes, at its downstream end, a flange attached to the rotor disk disposed immediately downstream of the blisks.

13. The apparatus of claim 12, wherein the tie-rod includes a taper in a direction of flow, and the flange of the tie-rod is attached to a radially outward portion of the rotor disk disposed immediately downstream of the blisks.

14. The apparatus of claim 13, wherein, the tie-rod ring is attached to the tie-rod by at least one bolted connection and includes an external threading, and the tensioning device is a tie-rod nut, which is threadedly engageable on the external threading of the tie-rod ring.

15. The apparatus of claim 14, wherein the tensioning device simultaneously retains a radially inner bearing ring of a tie-rod bearing.

16. The apparatus of claim 15, and further comprising at least one vortex reducer of a tubular type attached to the rotor disk disposed immediately downstream of the blisks.

17. An apparatus for retaining bladed rotor disks in a jet engine which includes an axial-flow compressor having a plurality of bladed rotor disks, with at least two bladed rotor disks at a compressor inlet side being designed as blisks where each blisk integrally combines a rotor disk and circumferentially distributed rotor blades; at least one turbine section; and at least one shaft interconnecting the compressor and turbine section; comprising:

at least one tie-rod, releasably retaining the blisks to one of the rotor disks disposed immediately downstream of the blisks while other rotor disks are firmly attached to each other and the one of the rotor disks separately and independently of the tie-rod such that the blisks can be separated from the rotor disks while the rotor disks remain attached to one another;

wherein the tie-rod is essentially tubular, coaxial with an axis of the compressor, disposed within central apertures in the blisks and firmly attached to the shaft;

wherein the tie rod includes at least one first arrangement disposed upstream of the blisks and at least one second arrangement disposed downstream of the blisks and connected to the one rotor disk disposed immediately downstream of the blisks and the blisks are retained via the tie rod between the first arrangement and the second arrangement and further comprising at least one vortex reducer of a tubular type attached to the rotor disk disposed immediately downstream of the blisks so as to be able to flow past a downstream end of the tie rod.

* * * * *